United States Patent [19]

Colonna des Princes

[11] 4,239,168

[45] Dec. 16, 1980

[54] RETAINING DEVICE FOR AN OBSTACLE RAIL

[76] Inventor: Louis Colonna des Princes, Haras de Vauptain, 78530 Buc, France

[21] Appl. No.: 7,927

[22] Filed: Jan. 30, 1979

[30] Foreign Application Priority Data

Mar. 9, 1978 [FR] France ..... 78 06788

[51] Int. Cl.[3] ..... A63B 5/02; A01K 15/02; F16M 13/00

[52] U.S. Cl. ..... 248/293; 119/29; 272/103

[58] Field of Search ..... 119/29; 272/101, 102, 272/103; 248/221.2, 293, 220.4, 475 B

[56] References Cited

U.S. PATENT DOCUMENTS

| | | | |
|---|---|---|---|
| 2,279,539 | 4/1942 | Vogt et al. | 119/29 |
| 3,514,062 | 5/1970 | Gordon | 119/29 X |
| 3,749,344 | 7/1973 | Racina | 272/101 X |

*Primary Examiner*—Hugh R. Chamblee
*Attorney, Agent, or Firm*—Young & Thompson

[57] ABSTRACT

The retaining device for each end of a fence rail of the type used in horse jumping contests comprises a mounting-piece and a bracket having two pins which can be inserted in an adjustable position in the holes of each side-post. The mounting-piece carries a U-shaped rail support which is capable of pivotal displacement about the pin of either a single or double hinge. The rail can thus be accurately positioned and falls freely as soon as it is struck.

8 Claims, 9 Drawing Figures

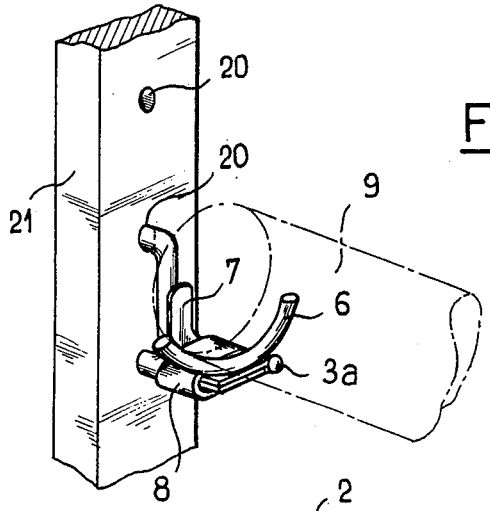
FIG. 5
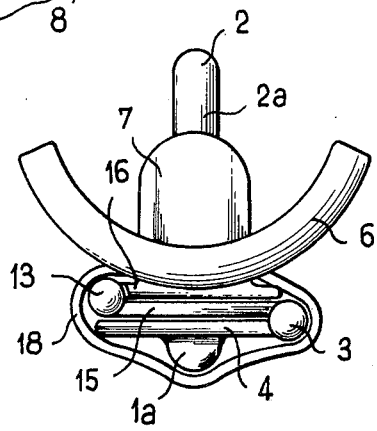
FIG. 7
FIG. 8
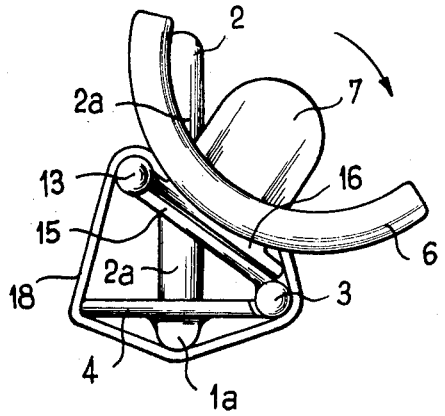
FIG. 9
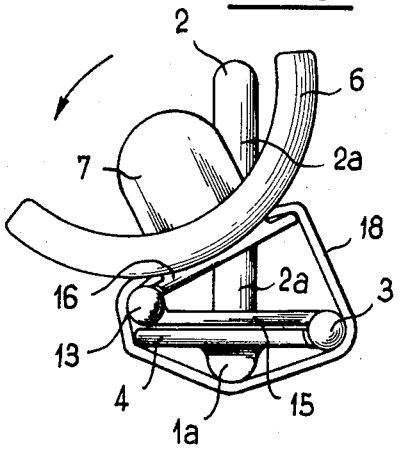

RETAINING DEVICE FOR AN OBSTACLE RAIL

This invention relates to a retaining device for an obstacle rail, especially of the fence rail or gate bar type used in horse jumping either for training or for show-jumping contests.

It is known that an obstacle of this type is constituted by a movable crossbar or rail which rests at each end on a cradle. A mounting-piece to which the cradle is rigidly fixed serves to place this latter at the desired height in different relatively spaced positions provided on a support structure. By way of example, these support structures can consist of vertical side-posts pierced by holes at predetermined intervals. Alternatively, said support structures can consist of horizontal or oblique bars which are also pierced by holes in spaced relation.

In the design mentioned above, the mounting-piece can be constituted by a bracket comprising one or two pins which are intended to be inserted in the holes of the support structure. This mounting-piece can also be provided with a fastening strap which surrounds the side-post and is retained in spaced notches located at the edges of this latter.

In the present state of the art, the cradle mentioned above has the shape of a quarter-circle and is rigidly fixed to a portion of the mounting-piece which is located in facing relation to the opposite side-post in order to ensure that the plane of said cradle is vertical and parallel to the plane of symmetry of the obstacle.

This design of rail-retaining device is attended by disadvantages and even by potential danger for the following reasons:

the rail simply rests on the bottom of the cradle, the upwardly curved ends of which prevent it from falling. Thus the rail can fall only after having been lifted above one of the two curved ends. This lifting movement can normally be caused by impact of a front limb of the horse during an upward movement which is effected in order to clear the obstacle. In this case the rail will hinder the horse to an even greater extent before falling out of the cradle, with the result that the horse will also be liable to fall. But the danger increases when either a front or a rear limb of the horse touches the rail under conditions such that the impact develops a downwardly directed force on the rail. In this case the rail cannot escape from the supporting cradles of its own accord unless it either breaks or rebounds. In any event the impact of the horse on the rail is liable to throw the horse completely off balance and to result in dangerous falls. It has been found in particular that falls of this type frequently result in a fracture of the third phalanx of the horse and in any case cause the horse to become stubborn. Furthermore, the replacement of broken rails is costly.

It is sometimes endeavored to remedy these defects by flattening the arcuate rail support or cradle in order to place the rail very close to one end of the cradle at the limit of equilibrium. But in order to ensure that it does not fall off accidentally, it proves necessary to apply the rail against the internal faces of the side-posts. This is liable to result in jamming, the dangerous consequences of which are well known.

Although less serious, a further disadvantage of the expedient described above lies in the fact that the height of the rail is not established with accuracy and is liable to vary when replacing the rail after this latter has fallen off. This in turn produces an adverse effect on regularity and consistency of standards in horse jumping contests.

The aim of the present invention is to circumvent these dangers and drawbacks and to ensure that the rail falls freely as soon as it is struck and also that it is positioned in an accurate manner.

In accordance with the invention, the retaining device for an obstacle rail comprising a mounting-piece which is intended to be fixed in an adjustable position on a side-post or like structure, said mounting-piece being adapted to carry a U-shaped member which serves as a rail support, is distinguished by the fact that said support is capable of pivotal displacement about at least one axis of the mounting-piece which is parallel to the rail when this latter is in the service position in the rail supports.

As soon as a thrust is exerted on the rail, the rail is thus brought to bear against one edge of the U-shaped support which immediately performs a pivotal movement and entirely releases the rail without any upward displacement of this latter. The invention thus makes it possible to construct a retractable safety rail-support.

Preferably, the device in accordance with the invention further comprises means which tend to restore the U-shaped rail support to its normal service position, namely the position corresponding to retention of the rail. In particular, said restoring means can be of the elastic type.

Thus the rail support has a well-defined normal service position and the same applies to the height of the rail. Moreover, in the event of pivotal displacement under the action of an impact, the rail support can be returned automatically to this normal service position.

In a first embodiment, the U-shaped rail support is secured to one of the plates of a simple hinge having a hinge-pin located in parallel relation to a bracket-pin which is intended to be inserted in a hole of a side-post or like structure. The other plate of said hinge is rigidly fixed to said bracket-pin and serves as a stop for the rail support in the normal service position.

In the rest position, the hinge is closed and its two plates are applied against each other. A transverse shock results in a movement of inclination of the upper hinge-plate to which the U-shaped support is secured, thus releasing the rail. This form of construction is both simple and economical but applies only to obstacles which are always intended to be cleared in the same direction on a given course.

In a second embodiment of improved design, the simple hinge is replaced by a double hinge and the U-shaped rail support is secured to the first plate of a hinge having hinge-pins which are parallel to a bracket-pin. The second plate provides a connection between the two hinge-pins whilst the third plate is rigidly fixed to said bracket-pin and serves as a stop for the rail support in the normal service position.

In the rest position, the three hinge-plates are stacked one above the other and the top plate which carries the U-shaped rail support is capable of pivotal displacement either to the left or to the right. This embodiment permits two-way jumping over obstacles.

In a preferred version of the invention which is primarily intended for use in conjuction with the two embodiments aforementioned, the retaining device comprises a small plate constituting a lateral thrust-bearing member for the rail and rigidly fixed to the U-shaped rail support in parallel relation thereto, said small plate being placed between said support and the bracket.

If the two side-posts or like structures which are placed at each end of the rail are each equipped with a device of the type described above, the rail is contained within the interval between the two small lateral-thrust plates; and since these small plates are rigidly fixed to the U-shaped rail supports and undergo pivotal displacement with these latter, any jamming of the rail against the side-posts is made impossible.

In accordance with another advantageous feature of the invention, the U-shaped rail support extends substantially in a semicircle.

In the prior art, an extension of the type just mentioned proved impossible by reason of the excessive lifting of the rail which it would have entailed. On the contrary, this extension is recommended within the purview of the invention since it ensures better maintenance of the rail as well as more accurate definition both of the position and of the height of the rail.

Further distinctive features and advantages of the invention will become apparent from the description which follows. The two aforementioned embodiments of the invention are illustrated in the accompanying drawings which are given by way of example without any limitation being implied, and in which:

FIG. 5 is a perspective view of the device which is mounted on the side-post;

FIG. 7 is a front view of the device in the second embodiment of the invention, looking to the side of the U-shaped rail support;

FIG. 8 is similar to FIG. 7 and shows the U-shaped rail support in an intermediate position of pivotal displacement towards the right;

FIG. 9 is similar to FIG. 8 and shows a similar pivotal displacement towards the left.

Figure 1:
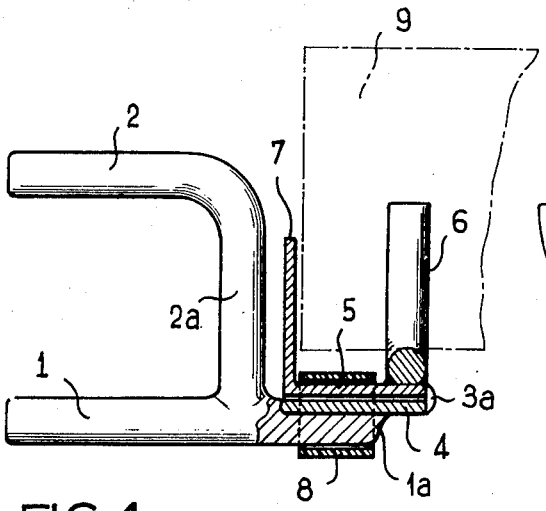
FIG. 1 is a view in side elevation of the device in the first embodiment of the invention, this view being taken partly in section along line I—I of FIG. 2 or of FIG. 3.

In the first embodiment of the invention described with reference to FIGS. 1 to 6, the retaining device is of the type in which the mounting-piece comprises a metal bracket constituted by a rectilinear pin 1 with its extension 1*a* and by a pin 2 which is parallel to the first, said pin 2 being elbowed at right-angle in the portion 2*a* of this latter which is welded to the pin 1. A U-shaped rail support 6 is placed at the front end of the bracket; the mid-plane of said support is vertical in the normal service position and perpendicular to the plane of the bracket-pins 1 and 2 which is also vertical and forms a plane of symmetry with the support 6.

In accordance with the invention, the U-shaped rail support 6 which is developed substantially in a semicircle is welded to the upper plate 5 of a simple hinge having a hinge-pin 3 which is parallel to the bracket-pin 1. Said hinge-pin terminates at the front end in a head 3*a* and at the rear end in a frusto-conical annular flange 3*b* obtained by swaging, for example. The lower plate 4 of the hinge is welded to the extension 1*a* of the pin 1 and serves as a stop for the plate 5 in the normal service position. A small vertical plate 7 which serves as a lateral thrust-bearing member for the obstacle rail is welded to the upper plate 5 of the hinge in parallel relation to the U-shaped rail support 6. An elastomer band 8 placed between the U-shaped rail support 6 and the small plate 7 surrounds the two plates 4 and 5 and the hinge-pin 3 and passes within the extension 1*a* of the bracket-pin 1. When the device is put into service, the bracket-pins 1 and 2 are inserted in the spaced holes 10 of a side-post 21 or like structure (as shown in FIG. 5); the obstacle rail 9 is placed in the support 6 and the end of said rail can be abuttingly applied against the small plate 7.

Figure 6:
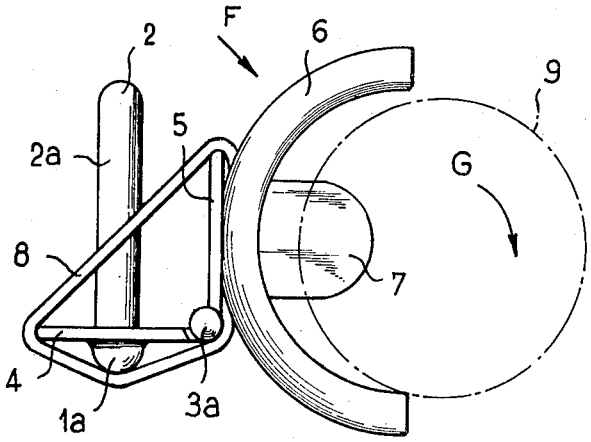
FIG. 6 is a view which is similar to FIG. 3 and shows the position of the U-shaped rail support after pivotal displacement through an angle of approximately 90°.

The operation of this device and its advantages over the prior art are readily apparent from FIG. 6. Thus, if the rail 9 is subjected to an impact from the left in the direction shown by the arrow F as a horse jumps over the obstacle, the U-shaped rail support 6 rotates in the direction G about the hinge-pin 3 and immediately releases the rail 9. The elastomer band 8 extends under the tension applied by the hinge-plates 4 and 5 as these latter are opened-out and thus restores the entire device to the normal service position as soon as the rail 9 has fallen. Since the small plate 7 which provides a lateral bearing face for the rail 9 is displaced in pivotal motion with the U-shaped support 6, said rail cannot possibly be frictionally applied against the elbowed portion 2*a* of the bracket-pin 2 and even less against the side-post 21.

The safety retaining device provided by the invention is thus retractable and automatic.

Figure 3:
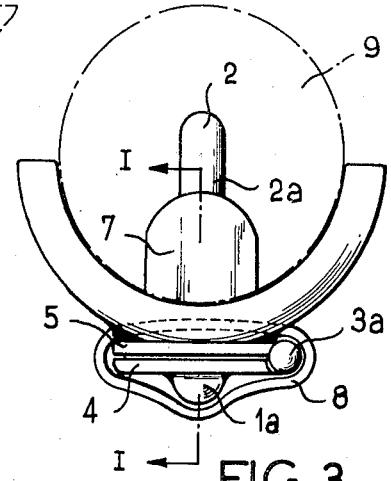
FIG. 3 is a front view of one side of the U-shaped rail support.
Figure 2:
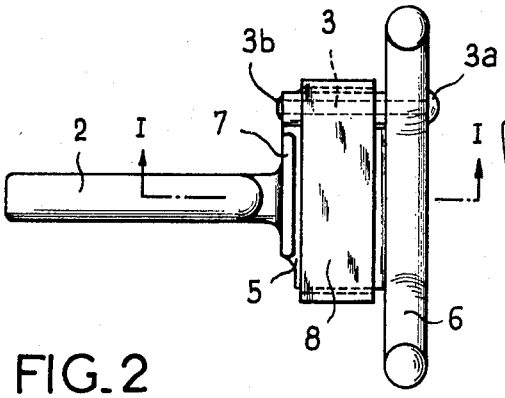
FIG. 2 is a plan view of said device.
Figure 4:
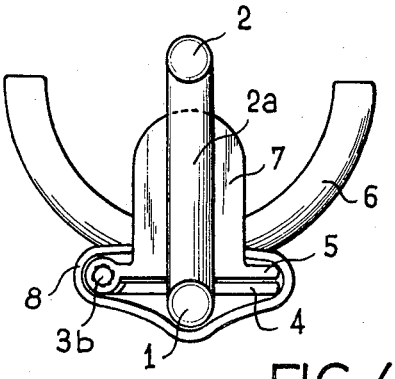
FIG. 4 is a rear view of one side of the bracket-pins.

On the other hand, the device having only one hinge-pin as considered in the first embodiment does not react to an impact which originates from the right-hand side of FIG. 3 and this has two consequences: on the one hand, an obstacle which is thus equipped can be cleared only in one direction; on the other hand, in order to equip the two oppositely-facing side-posts, provision must accordingly be made for one device which reacts towards the left and for a second device which reacts towards the right, thus making it necessary to stock both types of devices.

In the case of the second preferred embodiment illustrated in FIGS. 7 to 9, these limitations are removed. In this embodiment, the simple hinge of the first embodiment is replaced by a double hinge folded in the shape of a Z and comprising a bottom horizontal plate 4 which is welded to the extension 1*a* of the bracket-pin 1. Said bottom hinge-plate carries the pin 3 of a first hinge, the second plate 15 of which also forms part of a second hinge having a pin 13 which is parallel to the hinge-pin 3. Said second hinge has a top plate 16 which is adapted to carry both the U-shaped rail support 6 and the small plate 7 which provides a lateral bearing face for the rail. As in the first embodiment, the elastomer band 18 is placed between the rail support 6 and the small plate 7; said band surrounds all three plates 4, 15 and 16 of the double hinge and the two pins 3 and 13 of this latter as well as the extension 1*a* of the bracket-pin 1.

As can be seen from FIGS. 8 and 9, the double-articulation retaining device thus formed is capable of displacement in pivotal motion when the impact on the rod 9 comes from the left (as shown in FIG. 8) just as readily as when the impact comes from the right (as shown in FIG. 9). In both cases, as soon as the rail 9 is released, the elastic band 18 restores the double hinge assembly to the normal service position (shown in FIG. 7) in which the rail can be put back into position.

A device constructed as described in the foregoing therefore offers complete safety irrespective of its mode of utilization.

As will be readily understood, the invention is not limited to the two embodiments which have been given by way of example. Alternative modes of construction and execution can accordingly be contemplated.

From this it follows that the U-shaped rail support can have a shape other than a semicircle. It could extend over only one-third of a circle as in the case of FIGS. 7 to 9 or it could be constituted by two parallel arms joined together by a common perpendicular member.

Similarly, the retaining device need not be of metal but could be formed of wood or of rigid plastic material.

Modes of attachment other than the two-pin system can be provided for securing the retaining device to the side-post. For example, the lower pin 1 could be replaced by a fork which surrounds the side-post horizontally and clamps this latter. Similarly, the U-shaped rail support can be pivoted to a lug having a square or rectangular cross-section, said lug being intended to be engaged in one out of a series of similar slots disposed in spaced relation along a side-post or like structure. The pivot-pin of the U-shaped rail support could also be carried by a fastening strap which surrounds the side-post and is engaged in notches formed in this latter.

Finally, the means which serve to restore the U-shaped rail support to the service position could also be constituted by a helical spring placed around the hinge-pin 3 or alternatively by two magnetized components rigidly fixed respectively to the hinge plates.

By way of conclusion, it is also worthy of note that the invention offers the following advantages:

- in the event of falling of the rail, this latter does not move away to any great distance, and this holds true irrespective of the direction and force of the applied thrust by reason of the movement of rotation about the hinge and the embracing character of the U-shaped rail support;
- in all cases, the kinetic energy of the impact is never transmitted to the side-posts and these latter are no longer liable to be knocked down;
- the retaining device always reacts in the same manner in respect of the same intensity and direction on impact on the rail;
- if the impact on the rail is of small magnitude, said rail no longer falls and is automatically restored to its initial position.

I claim:

1. A retaining device for an obstacle rail comprising a mounting-piece including means for securing the retaining device at an adjustable level on a side-post or the like, the retaining device further comprising a U-shaped member adapted to receive and support a portion of a rail and a hinge having two plates connected by a hinge-pin which is parallel to a said rail in the supported position of a said rail, one of the plates being rigidly secured to the U-shaped member and being movable between a rest position in which the U-shaped member is adapted to serve as a rail support and a position in which the U-shaped member is adapted to release a supported rail, the other plate being secured to the mounting piece and being adapted to serve as a stop for the U-shaped member in the rest position.

2. A device according to claim 1, wherein said device comprises a small plate constituting a lateral thrust-bearing member for a said rail and rigidly fixed to the U-shaped member in parallel relation thereto, said small plate being disposed between said U-shaped member and the mounting-piece.

3. A device according to claim 1, wherein an elastomer band surrounds the two plates of the hinge and the hinge-pin.

4. A device according to claim 2, wherein the first plate is rigidly fixed to an extension of the mounting piece and the second plate carries both the U-shaped rail support and the small lateral thrust bearing plate.

5. A retaining device for an obstacle rail comprising a mounting piece including means for securing the retaining device at an adjustable level on a side-post or the like, the retaining device further comprising a U-shaped member adapted to receive and support a portion of a rail and a double hinge having three plates connected by two hinge pins which are parallel to a said rail in the supported position of a said rail, the first of said plates being rigidly secured to the U-shaped member and being movable between a rest position in which the U-shaped member is adapted to serve as a rail support and at least two positions in which the U-shaped member is adapted to release a supported rail, the second plate connecting both hinge pins and the third plate being secured to the mounting piece and being adapted to serve as a stop for the U-shaped member in the rest position.

6. A device according to claim 5, wherein said device comprises a small plate constituting a lateral thrust-bearing member for a said rail and rigidly fixed to the U-shaped member in parallel relation thereto, said small plate being disposed between said U-shaped member and the mounting piece.

7. A device according to claim 5 wherein an elastomer band surrounds the first, second and third plates of the hinge and both hinge pins.

8. A device according to claim 6, wherein the first plate is rigidly fixed to an extension of the mounting piece, and the third plate carries the U-shaped rail support and the small lateral bearing plate.

* * * * *